US007390215B2

(12) United States Patent
Liao et al.

(10) Patent No.: US 7,390,215 B2
(45) Date of Patent: Jun. 24, 2008

(54) BATTERY CONNECTOR

(75) Inventors: Chih-Yuan Liao, Tu-Cheng (TW); Hsiang-Ping Chen, Tu-Cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 11/810,241

(22) Filed: Jun. 5, 2007

(65) Prior Publication Data

US 2007/0281540 A1 Dec. 6, 2007

(30) Foreign Application Priority Data

Jun. 5, 2006 (TW) ..... 95209731 U

(51) Int. Cl.
*H01R 3/00* (2006.01)

(52) U.S. Cl. ..... 439/500; 429/96

(58) Field of Classification Search ..... 439/68, 439/500; 429/96, 97, 98, 99, 100
See application file for complete search history.

(56) References Cited

U.S. PATENT DOCUMENTS 5,980,309 A 11/1999 Whitaker
6,603,670 B1 * 8/2003 Chien ..... 361/801
6,669,504 B2 * 12/2003 Wu ..... 439/500
6,722,916 B2 * 4/2004 Buccinna et al. ..... 439/500
6,911,279 B2 * 6/2005 Po et al. ..... 429/96
7,059,894 B1 * 6/2006 Huang ..... 439/500
7,238,045 B1 * 7/2007 Chang ..... 439/500

* cited by examiner

*Primary Examiner*—Thanh-Tam T Le
(74) *Attorney, Agent, or Firm*—Wei Te Chung

(57) ABSTRACT

A battery connector (100) for a disk-shaped battery having positive and negative electrodes includes an insulative housing (1) having surface mountable positive and negative terminals (2, 3) received therein. The insulative housing defines a battery receiving cavity dimensioned to receive the disk-shaped battery. The negative terminal (3) includes a spring contact portion (33) extending from a base wall so as to be engagable with the negative electrode on a bottom surface of the battery when the battery is inserted in the battery connector. The positive terminal (2) includes a spring contact section (23) adapted to engage the positive electrode on an opposed upper surface of the battery when the battery is insertable within the battery connector, and a deflectable connection section (22) attached to the spring contact section so as to permit the spring contact section to be flexed outwardly thereby allowing release of the battery from the battery connector.

6 Claims, 3 Drawing Sheets

BATTERY CONNECTOR

BACKGROUND OF THE INVENTION

1. Field of the Invention

The present invention relates to the art of electrical connectors, and more particularly to connectors for a disk-shaped cell or battery.

2. The General Background

Disk-shaped cells or batteries are often used as back up protection for electronic equipment should there be a failure in the conventional power system. Typically these disk-shaped back-up cells are relatively small, and are often referred to as "button baterries". The cell has a positive electrode extending along a major surface and an edge, and a negative electrode extending over the other major surface and isolated from the positive electrode. For purposes of this invention, the term "battery" is to be understood to include a single cell. The battery is inserted into a connector housing mountable onto a circuit board, the connector hereinafter referred to as a "battery connector". It is desirable that a back up battery connector require a minimum amount of space on a circuit board within the equipment, be readily accessible for replacing a depleted battery. Furthermore, it is sometimes desirable to provide a back-up battery connector that is oriented horizontally on the circuit board to which it is mounted.

In the prior art of horizontally oriented battery connectors, the battery is placed in an "open" pocket or housing of a battery connector, that is, the housing base includes contacts that extend through the housing base and the battery is disposed over or between the contacts. In most instances, the placement of the battery onto the housing is often achieved by lateral shift of the battery onto the housing, and then pressing the battery against sidewalls and bottom walls of the battery connector so as to securely hold the battery in the battery connector. The lateral shift of the battery onto the housing will invade a "real estate" above the circuit board, which is undesirable for the back up battery connector as mentioned above.

SUMMARY OF THE INVENTION

According to an embodiment of the present invention, a battery connector is provided for a disk-shaped battery having positive and negative electrodes. The battery connector includes an insulative housing having surface mountable positive and negative terminals received therein. The insulative housing includes a base wall and opposed sidewalls together defining a battery receiving cavity dimensioned to receive the disk-shaped battery. The base wall includes two terminal receiving passageways extending therethrough, with one proximate to each of the side walls. The negative terminal includes a spring contact portion extending from an upper surface of the base wall so as to be engagable with the negative electrode on a bottom surface of the battery when the battery is inserted in the battery connector. The positive terminal includes a spring contact section adapted to engage the positive electrode on an opposed upper surface of the battery and retain the battery in the battery receiving cavity when the battery is insertable within the battery connector. And a deflectable connection section is attached to the spring contact section so as to permit the spring contact section to be flexed outwardly, thereby allowing release of the battery from the battery connector or facilitating the placement of the battery onto the battery connector, with no need of occupying an additional "real estate" of the circuit board during the removal or placement of the battery onto the battery connector.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
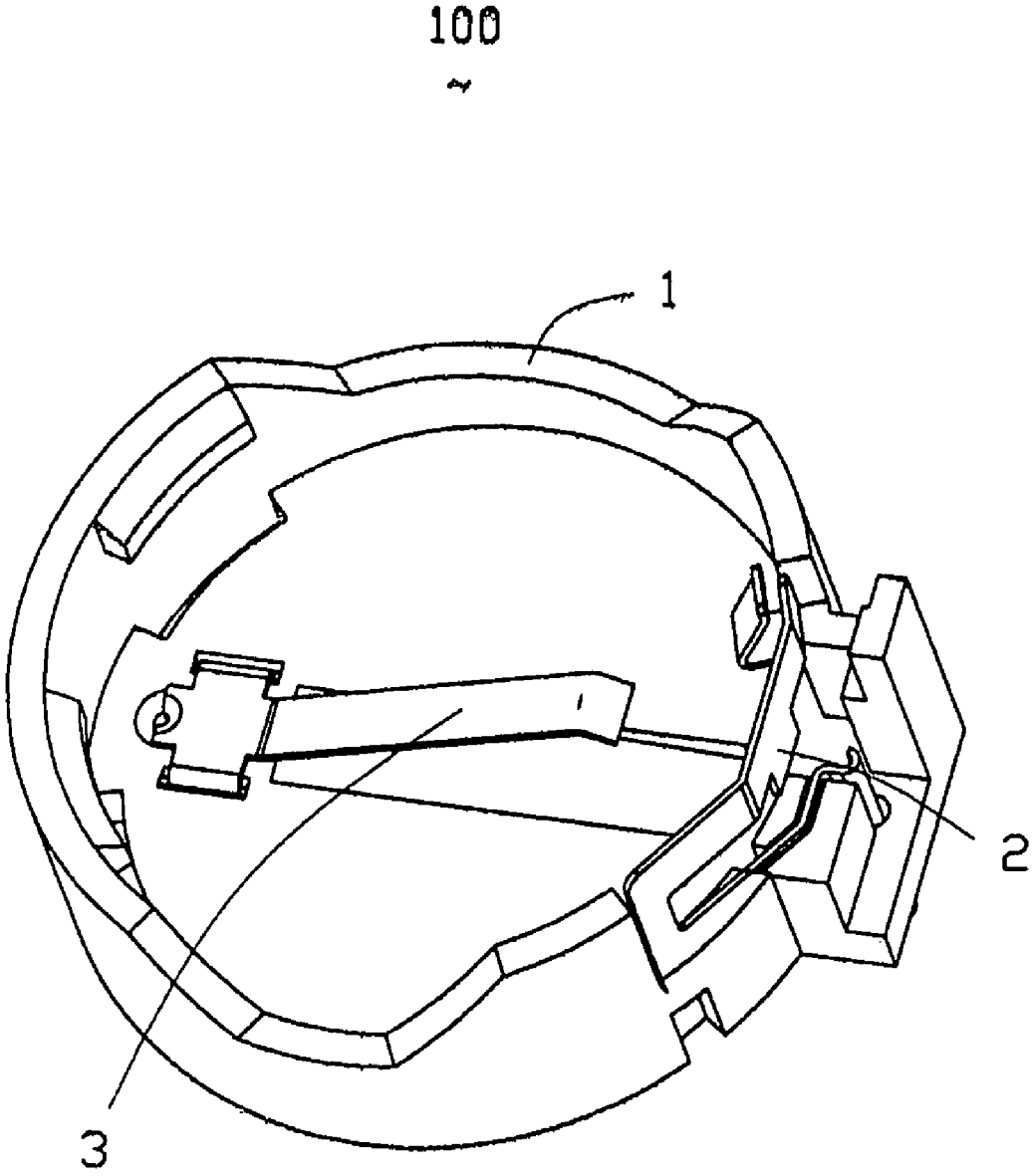
FIG. 1 is a perspective view of a battery connector according to an embodiment of the present invention, with positive and negative terminals exploded therefrom.
Figure 2:
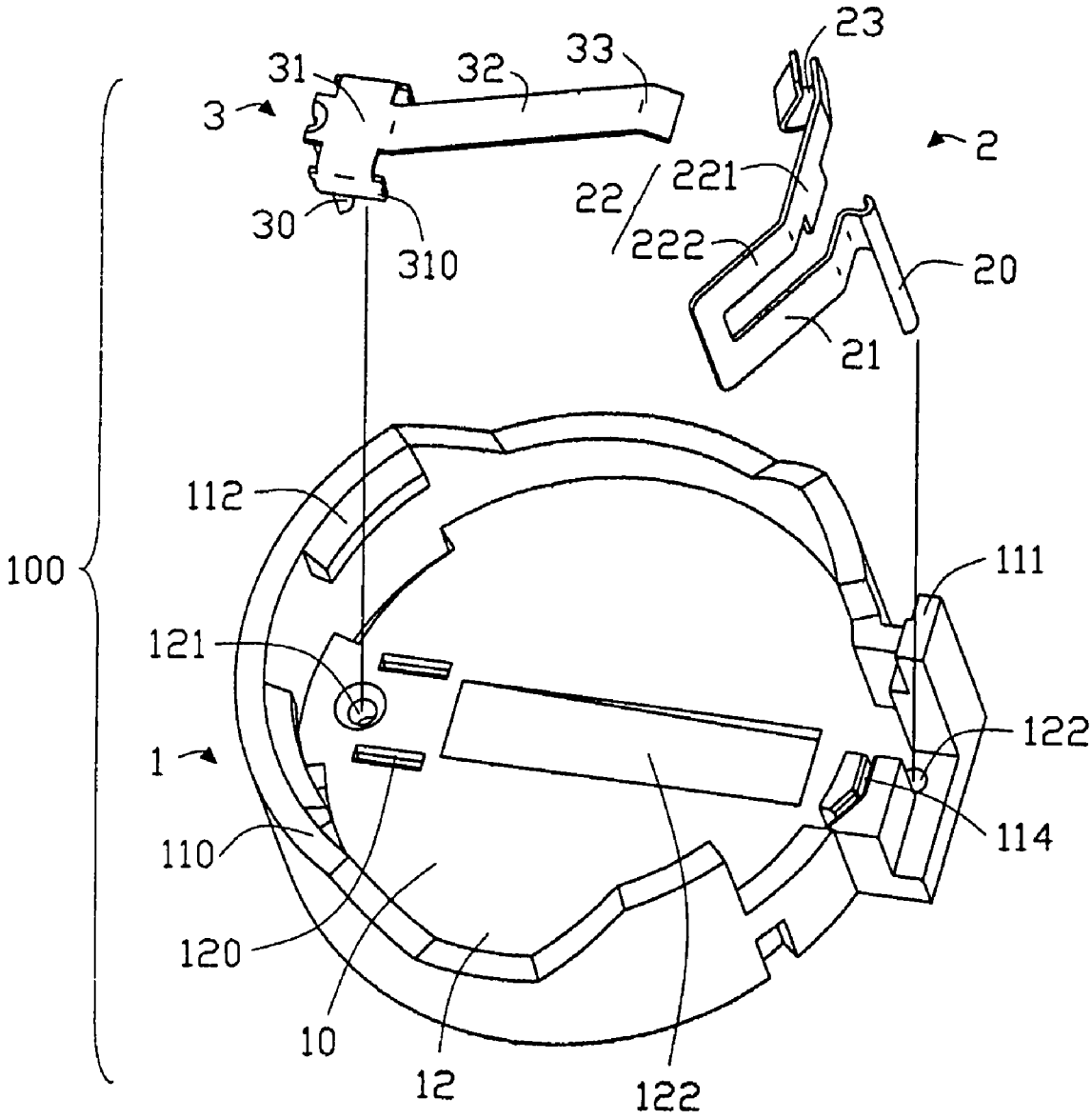
FIG. 2 is an assembled, perspective view of the battery connector of FIG. 1.
Figure 3:
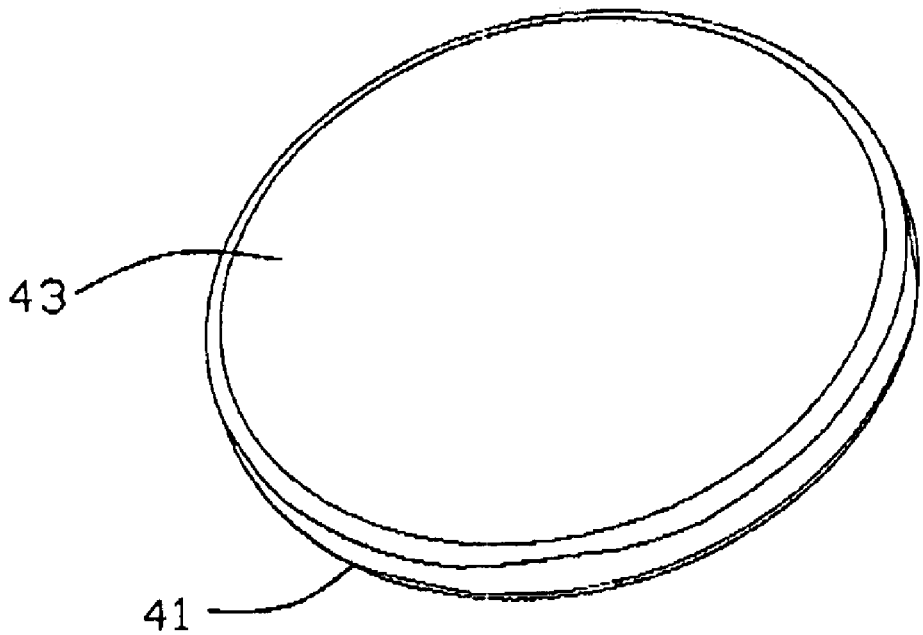
FIG. 3 is a perspective view of a battery connector assembly including the battery connector of FIG. 1 and a disk-shaped battery to be assembled thereto.
Figure 3:
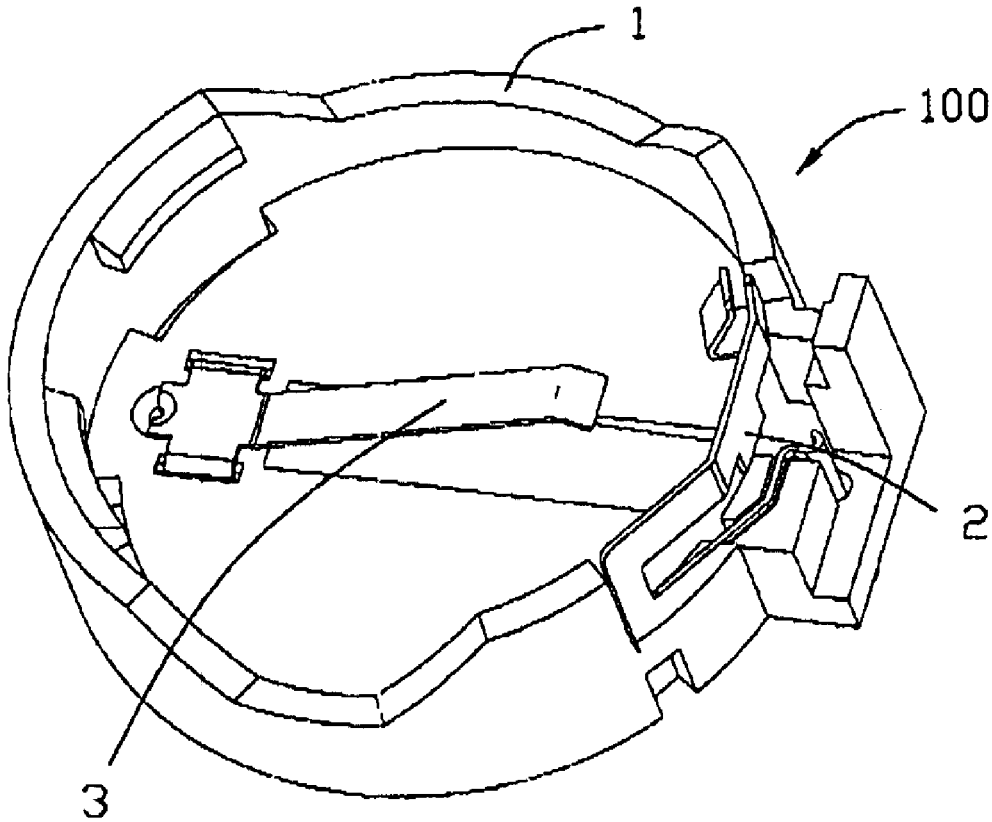

Referring to FIGS. 1 to 2, a battery connector 100 for a disk-shaped battery is shown according to one embodiment of the present invention. The battery connector 100 includes an insulative housing 1 with surface mountable positive and negative terminals 2 and 3 disposed therein.

The insulative housing 1 includes a base wall 12 and opposed side walls 110 and 111 together defining a battery receiving cavity 10 dimensioned to receive the disk-shaped battery (not shown) therein. One side wall 110 proximate to the surface mountable negative terminal 3 includes a pair of inwardly-directed retention flanges 112 that extend parallel to and are spaced above the base wall 12. The flanges 112 are dimensioned to engage and extend over a respective portion of an upper surface of the battery to secure the battery in the housing 1 at one side of the battery. A slot 114 around the opposite side wall 111 is provided for receiving a base section 21 of the positive terminal 2 therein so as to secure the positive terminal 2 in position. The base wall 12 includes first and second terminal receiving passageways 121 and 122 being at spaced locations for receiving the respective positive and negative terminals 2 and 3 therein, with one receiving passageway 121 or 122 proximate to each of the side walls 110 or 111. The base wall 12 further includes a recessed portion extending into a top major surface of the base wall 12. The recessed portion includes an elongated slot 122 dimensioned to receive a spring contact arm 32 of the negative terminal 3 therein so as to permit a spring contact section 33 near a distal region of the spring contact arm 32 to be extended from the top major surface of the base wall 12 to be engageable with the negative electrode on a bottom surface 41 of the battery when the battery is inserted in the battery connector 100.

The negative terminal 3 includes a body 31 having retention barbs 310 extending outwardly from opposite side edges thereof for being inserted into a pair of slots 120 of the base wall 12, with an elongated connecting section 30 extending downwardly from the body 31 to be received within the first terminal receiving passageway 121 and having a distal end exposed out of a bottom surface of the base wall 12. The negative terminal 3 further includes the spring contact arm 32 extending from one side of the body 31 to be at an angle with the body 31, wit the spring contact section 33 formed around the distal region of the spring contact arm 32 for being engageable with the negative electrode on the bottom surface 41 of the battery when the battery is inserted in the battery connector 100.

The positive terminal 2 includes the base section 21 being of a sheet shape and bent at a middle portion thereof for being inserted into the slot 114 around the side wall 111, with a connection leg 20 extending downwardly from one end of the base section 21 for being received in a through hole of a circuit board (not shown). A deflectable connection section 22 extends from an opposite end of the base section 21, and is spaced substantially parallel to the base section 21. The deflectable connection section 22 is spaced in a manner such that the deflectable connection section 22 is of a sufficient flexibility to permit a contact section 23 near a free end region of the deflectable connection section 22 to be flexed outwardly with respect to the base section 217 thereby allowing release of the battery from the battery connector 100. The deflectable connection section 22 is arranged essentially along a periphery of the housing 1 of the battery connector 100, and further includes a first connection arm 222 and a second connection arm 221 attached to the first connection arm 222, with an angle formed therebetween. The contact section 23 is formed near the free end region of the deflectable connection section 22 for being engageable with the positive electrode on the upper surface of the battery, also functioning as a retention structure for retaining the battery in the battery receiving cavity 10 when the battery is insertable within the battery connector 100. The contact section 23 includes a planar contact surface substantially perpendicular to the deflectable connection section 22, and further parallel to and spaced above the upper surface of the base wall 12 so as to engage on the positive electrode on an upper surface 43 of the battery.

Referring to FIG. 2, in assembly, the negative terminal 3 is assembled onto the base wall 12 by its retention barbs 310 insertable within the slots 120, and the elongated connecting section 30 received within the first terminal receiving passageway 121, with the spring contact arm 32 extending from the bottom surface of the base wall 12. The positive terminal 2 is assembled onto the base wall 12 by it connection leg 20 received within the second terminal receiving passageway 122, and the base section 21 insertable into the slot 114 of the battery connector 100, with the deflectable connection section 22 to be flexed outwardly with respect to the side wall 111 of the battery connector 100. In use, the battery is placed within the battery receiving cavity 10 by flexing the deflectable connection arm 22 of the positive terminal 2 outwardly, and held within the battery connector 100 in position by the combination of the retention flanges 112 of one side wall 110 and the contact section 23 of the positive terminal 2. As compared with the prior art, the providence of the deflectable connection section 22 can permit the contact section 23 of the positive terminal 2 to be flexed outwardly with respect to the base section 21, thereby allowing release of the battery from the battery connector 100 or facilitating the placement of the battery onto the battery connector 100, with no need of occupying additional "real estate" of the circuit board during the removal or placement of the battery onto the battery connector 100.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. A battery connector for a disk-shaped battery having positive and negative electrodes, the battery connector comprising:

an insulative housing having a base wall and a periphery wall together defining a battery receiving cavity adapted to receive the disk-shaped battery, the base wall including two terminal receiving passageways extending therethrough;

a positive terminal and a negative terminal disposed in the respective terminal receiving passageways;

the negative terminal including a spring contact portion extending from an upper surface of the base wall so as to be engagable with the negative electrode on a bottom surface of the battery when the battery is inserted in the battery connector;

the positive terminal including a spring contact section adapted to engage the positive electrode on an opposed upper surface of the battery and retain the battery in the battery receiving cavity when the battery is disposed within the battery connector, and a deflectable connection section attached to said spring contact section so as to permit said spring contact section to be flexed outwardly thereby allowing release of the battery from the battery connector; and wherein the deflectable connection section defines, from a top view thereof, a V-shape with its opening towards the battery receiving cavity so as to cooperate with the periphery wall to form the battery receiving cavity adapted to receive the disk-shaped battery; and wherein the deflectable connection section defines a lying U-shape with opposite upper and lower arms linked by a bridge.

2. The battery connector of claim 1, wherein said spring contact section includes a planar contact surface parallel to and spaced above the upper surface of the base wall.

3. The battery connector of claim 2, wherein said deflectable connection section extends substantially perpendicular to said contact surface of the positive terminal.

4. The battery connector of claim 1, wherein said periphery wall proximate to the positive terminal includes inwardly-directed retention flanges parallel to and spaced above the upper surface of the base wall and dimensioned to engage the battery when the battery is inserted in the battery connector and extend over a respective portion of We upper surface of the battery to secure the battery in the housing at a location substantially opposite to that of the spring contact section of die positive terminal.

5. A battery connector for a disk-shaped battery having positive and negative electrodes, the battery connector comprising:

an insulative housing having a base wall and a periphery wall together defining a battery receiving cavity dimensioned to receive the disk-shaped battery, a positive terminal receiving passageway and a negative terminal receiving passageway formed in the housing, respectively;

a positive terminal and a negative terminal disposed in the respective terminal receiving passageways;

the negative terminal including a spring contact portion extending from an upper surface of the base wall so as to be engagable with the negative electrode on a bottom surface of the battery when the battery is inserted in the battery connector;

the positive terminal including a transverse spring contact section adapted to engage the positive electrode on an opposed upper surface of the battery and retain the battery in the battery receiving cavity when the battery is insertable within the battery connector, and an up and down deflectable connection section attached to said spring contact section so as to permit said spring contact section to be flexed outwardly thereby allowing release of the battery from the battery connector; and wherein the deflectable connection section defines a living U-shape with opposite upper and lower arms linked by bridge, wherein the upper arm is deflectable while the lower arm is restrained by the periphery wall; and wherein the deflectable connection section defines, from a top view thereof, a V-shape with its opening towards the battery receiving cavity.

6. The battery connector as claimed in claim 5, wherein said spring contact section includes a planar contact surface parallel to the upper surface of the base wall, the deflectable connection section extends substantially perpendicular to the contact surface of the positive terminal.

* * * * *